US005971405A

United States Patent [19]

Edauw

[11] Patent Number: 5,971,405

[45] Date of Patent: Oct. 26, 1999

[54] ICE- OR ROLLER-SKATE

[75] Inventor: Peter Edauw, Povegliano, Italy

[73] Assignee: Stylus S.p.A., Italy

[21] Appl. No.: 08/606,066

[22] Filed: Feb. 23, 1996

[51] Int. Cl.[6] ..... A63C 1/24

[52] U.S. Cl. ..... 280/11.14

[58] Field of Search ..... 280/11.12, 11.14, 280/11.15, 11.17, 11.18, 11.28

[56] References Cited

U.S. PATENT DOCUMENTS

| | | | |
|---|---|---|---|
| 2,197,170 | 4/1940 | Anderson | 280/11.12 |
| 2,242,870 | 5/1941 | Prosey | 280/11.18 |
| 2,348,475 | 5/1944 | Howard | 280/11.18 |
| 4,126,323 | 11/1978 | Scherz | 280/11.12 |
| 5,498,009 | 3/1996 | Young | 280/11.12 |

*Primary Examiner*—Robert J. Oberleitner
*Assistant Examiner*—Robert A. Siconolfi
*Attorney, Agent, or Firm*—Rockey, Milnamow & Katz

[57] ABSTRACT

A skate comprising a boot having attached to its sole a support for mounting at least one element for a movement on a base surface, such an ice skate or a roller skate, comprising an insole with a downwards directed extension interacting with the at least one element at a location disposed between vertical axis passing through the ankle of a user and a vertical axis passing through the point of blade roller surface contact.

6 Claims, 5 Drawing Sheets

ICE- OR ROLLER-SKATE

BACKGROUND OF THE INVENTION

The present invention relates to a skate, more specially to a skate comprising a boot provided at its bottom side with a support for mounting at least one means for a movement on a base surface. The skate according to the invention is an ice skate or a roller inline skate.

In a known embodiment, an ice skate comprises a boot composed of a leg portion hingedly connected at the location of the ankle to a foot portion having a downwards directed extension in the form of a substantially U-shaped support for mounting the runner blade. The foot portion is usually connected to the U-shaped support at the heel and toe locations. The runner blade is of perfect curvilinear radius configuration with the concave side facing upwards, and the point of blade-ice contact is positioned forwards corresponding with the vertical axis passing through the skater's center of gravity.

Inasmuch as the optimization of the skating performance requires the skater to apply the necessary thrust within the range between the vertical axis passing through his ankle and the vertical axis passing through the center of blade, it is evident that known skates of this type will never lend themselves to any such optimization, since the U-shaped configuration of the support results in that the thrust is exercized at the toe and heel locations, i.e. outwards of the desired location.

SUMMARY OF THE INVENTION

It is an object of the invention to eliminate this inconvenience and to create an ice skate permitting the skater to transmit the thrust action to a suitably determined location of the runner blade.

This object and others to become evident from the following description are attained according to the invention by an ice skate comprising a boot having attached to its sole a support for mounting the runner blade, characterized in that it comprises an insole with a downwards directed extension interacting with the blade at a location disposed between the vertical axes passing respectively through the ankle and the vertical axis through center of boot/blade.

In a known embodiment, a roller skate comprises a boot having a leg portion articulated at the location of the ankle to a foot portion the sole of which has attached thereto a support for mounting a plurality of rollers in longitudinal alignment with one another.

In view of the fact that the optimization of the skating performance requires the skater to exert the necessary thrust at a location disposed between the vertical axis passing through the ankle of his foot and the vertical center axis of the boot, it is evident that these known

- roller or inline skates do not readily lend themselves to such optimization, since
- unskilled skaters practice the sport in a substantially erect posture, as a result of which the thrust is exerted along the axis passing through the center of boot or even in front thereof and
- unskilled skaters practice the sport with their body bent forward substantially at right angles to their legs, as a result of which the center of gravity of body along an axis forwards of the center axis of the boot/blade or frame.

It is an object of the invention to eliminate these shortcomings and to provide a roller skate permitting the skater to exert the required thrust at a location disposed between the vertical axis passing through the ankle and the center axis of the boot.

This object and others to become evident from the following description are attained according to the invention by a roller skate comprising a boot provided at its bottom side with a support for mounting a plurality of rollers in longitudinal alignment with one another, characterized in that the sole of the boot is provided with a downwards directed prismatic extension having attached thereto a support for mounting the rollers, said extension being disposed at a location between vertical axes passing respectively through the ankle and through the longitudinal center of the boot.

BRIEF DESCRIPTION OF THE DRAWINGS

The invention shall be further explained with reference to the accompanying drawings, wherein.

DESCRIPTION OF THE PREFERRED EMBODIMENTS

Figure 1:
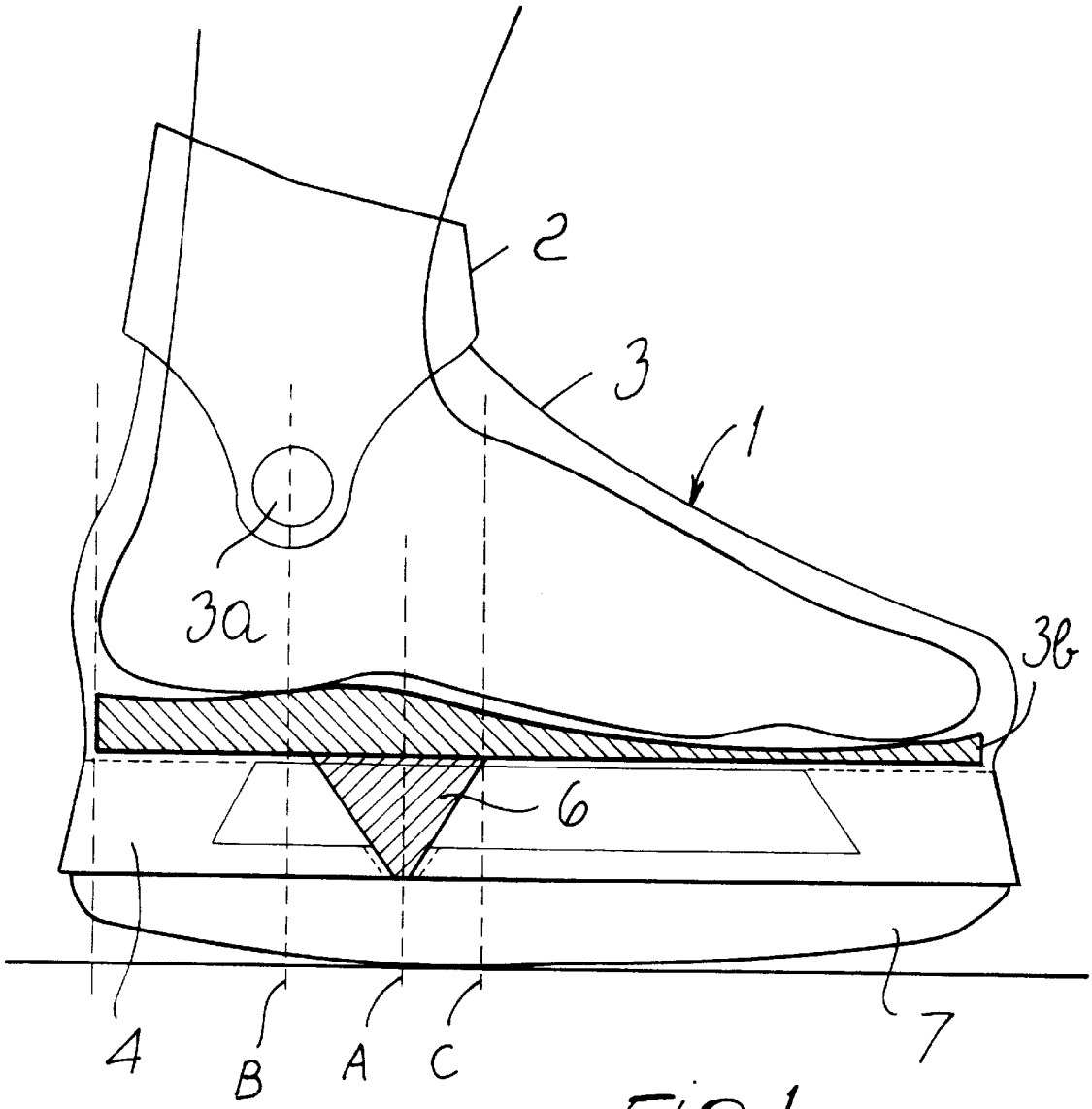
FIG. 1 shows a partially sectioned side view of an ice skate according to an embodiment of the invention.
Figure 2:
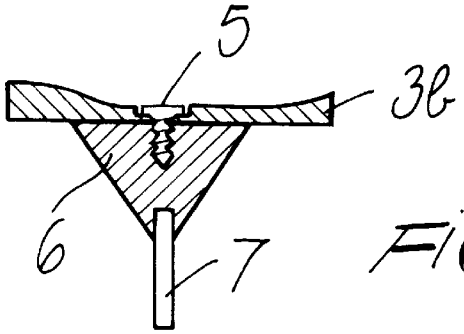
FIG. 2 shows a partial cross-sectional view thereof.

As shown in the drawings, according to FIGS. 1 and 2, the ice skate according to the invention substantially comprises a boot 1 with a leg portion 2 articulated by means of two pivots 3*a* adjacent the location of the ankle to a foot portion 3 having a downwards directed extension in the form of a substantially U-shaped support 4 for a runner blade 7 of arcuate shape mounted with its concave side facing upwards.

Accommodated within foot portion 3 is an insole 3*b* provided on its lower side with a prop 6 of substantially frustopyramidal shape with its greater base secured to insole 3*b* by screws 5 and its smaller base taking support on runner blade 7. Prop 6 extends from foot portion 3 through a correspondingly shaped aperture formed in the sole and provided with a sealing gasket (not shown in the drawings).

The vertical axis A of prop 6 is disposed between vertical axes B and C passing respectively through the ankle and the point extremity of runner blade in relation of the foot/boot.

Insole 36 and prop 6 are made of a plastic material substantially more rigid than the material used for foot portion 3 and support 4. In other cases prop 6 may be made of a metallic material such as aluminum or the like.

It is evident that thanks to the positioning of prop 6, the thrust forces exerted by the skater on insole 3*b* are transmitted to runner blade 7 at the optimum location, and that even when the skater does not assume the perfectly correct skating attitude.

Figure 3:
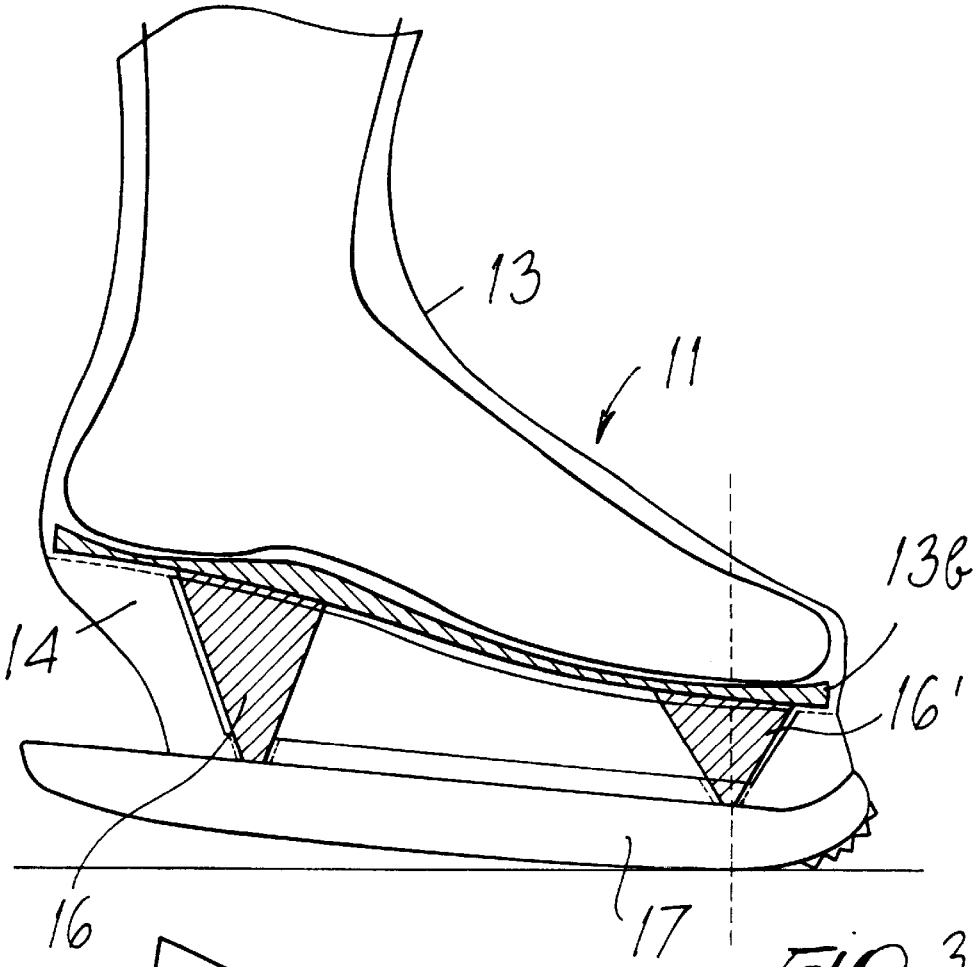
FIG. 3 shows a second embodiment of the ice skate.

In the embodiment illustrated in FIG. 3, insole 13*b* has its lower side provided with two props 16 and 16', with the vertical axis of prop 16 disposed along the axis passing through the ankle and that passing through the point of extremity of runner blade in relation of the foot/boot and the vertical axis of prop 16', passing through the toe end of the foot. This ice skate lends itself particularly well for use in figure-skating.

Figure 4:
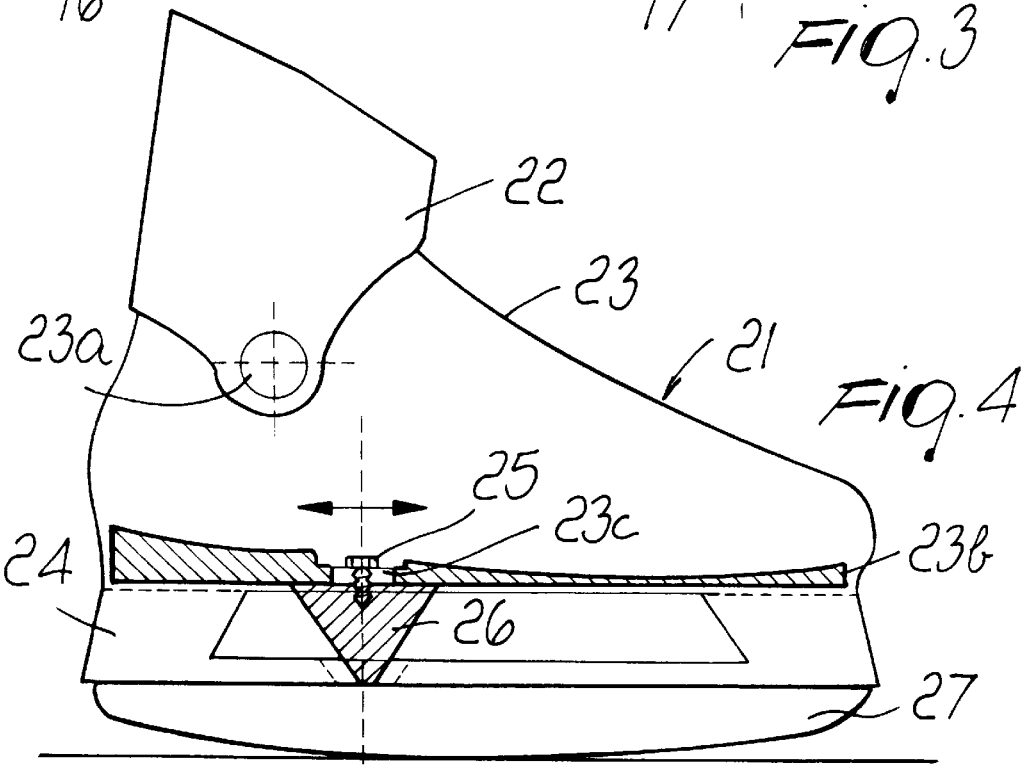
FIG. 4 shows a third embodiment of the ice skate.

In the embodiment illustrated in FIG. 4, insole 23*b* of the foot portion 23 of the boot 21 is formed with a longitudinally extended slot opening 23*c* for receiving therein the screw 25 for fixing prop 26 on the underside. This embodiment permits prop 26 to be longitudinally displaced to thereby vary its point of attack. Point of transmission of thrust on blade in relation with ankle and extremity of blade.

Figure 5:
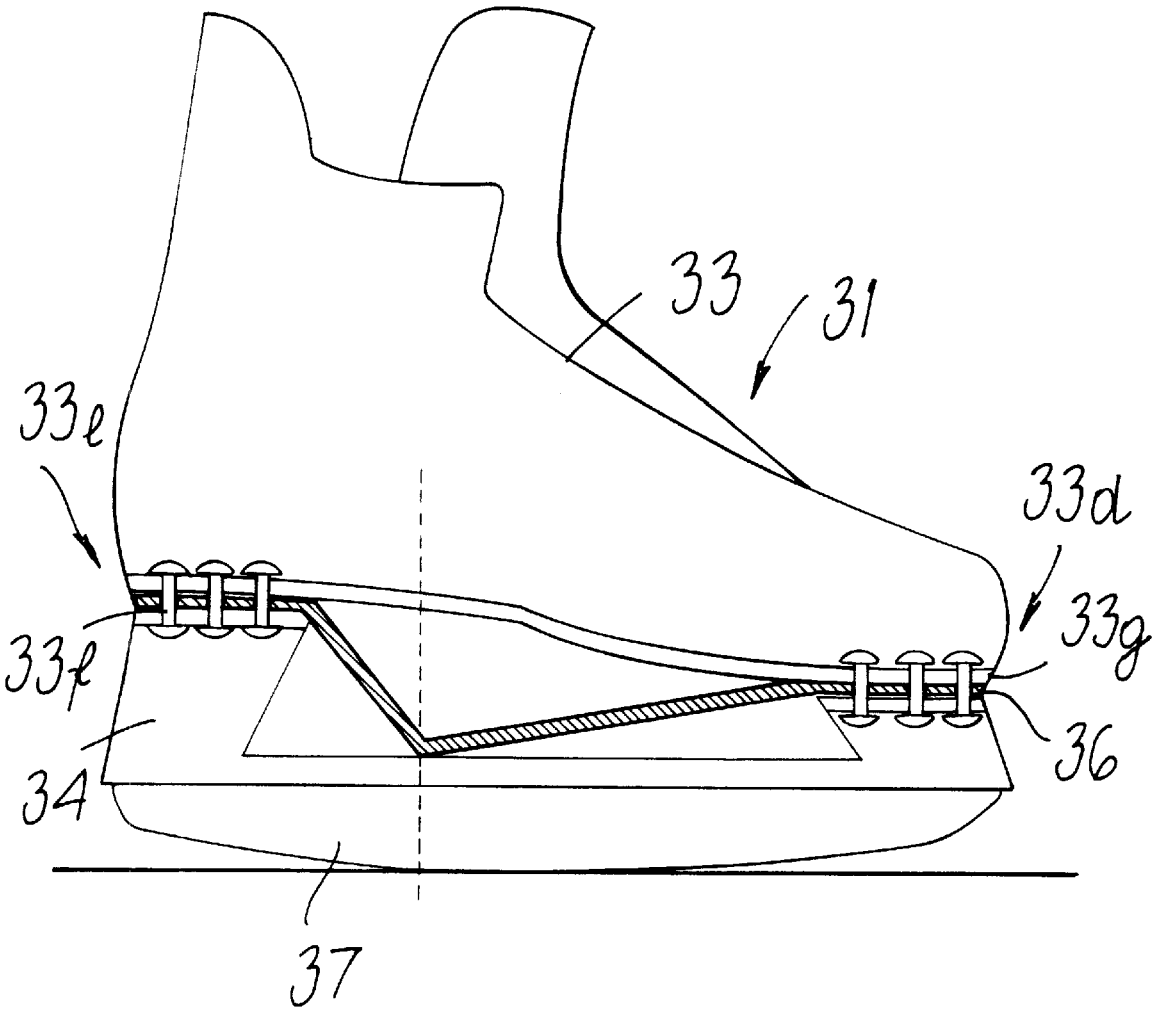
FIG. 5 shows a fourth embodiment of the ice skate.

In the embodiment illustrated in FIG. 5, there is arranged between the lower surface of the sole 33*g* of the boot 31 and the top surface of the support 34 of runner blade 37 at the locations of the toe 33*d* and heel 33*e* portions of the foot portion 33 a sole reinforcement 36 with appendix, triangular or pyramidically shaped which concentrates the effort in a well definite point. In this case sole reinforcement 36 has a sharply bent profile permitting it to take support on runner blade 37 at a location between the vertical axes passing through the ankle and through the point of contact between the runner blade and the ice in resting position. As it is shown in FIG. 5 axis A crosses the lowest point of sole replacement 36. Furthermore it is also shown in this figure that the sole 36 is fastened to the toe and heel portions 33*d* and 33*e* respectively of the boot 33 by means of rivets 33*f*.

It should be noted that in the embodiments according to FIGS. 3 and 5 the articulation of the leg portion on the foot portion is not shown. Nevertheless, these variants can contain also articulations adjacent the location of the ankle as it is disclosed in connection with the embodiments in FIGS. 1 and 3.

Figure 6:
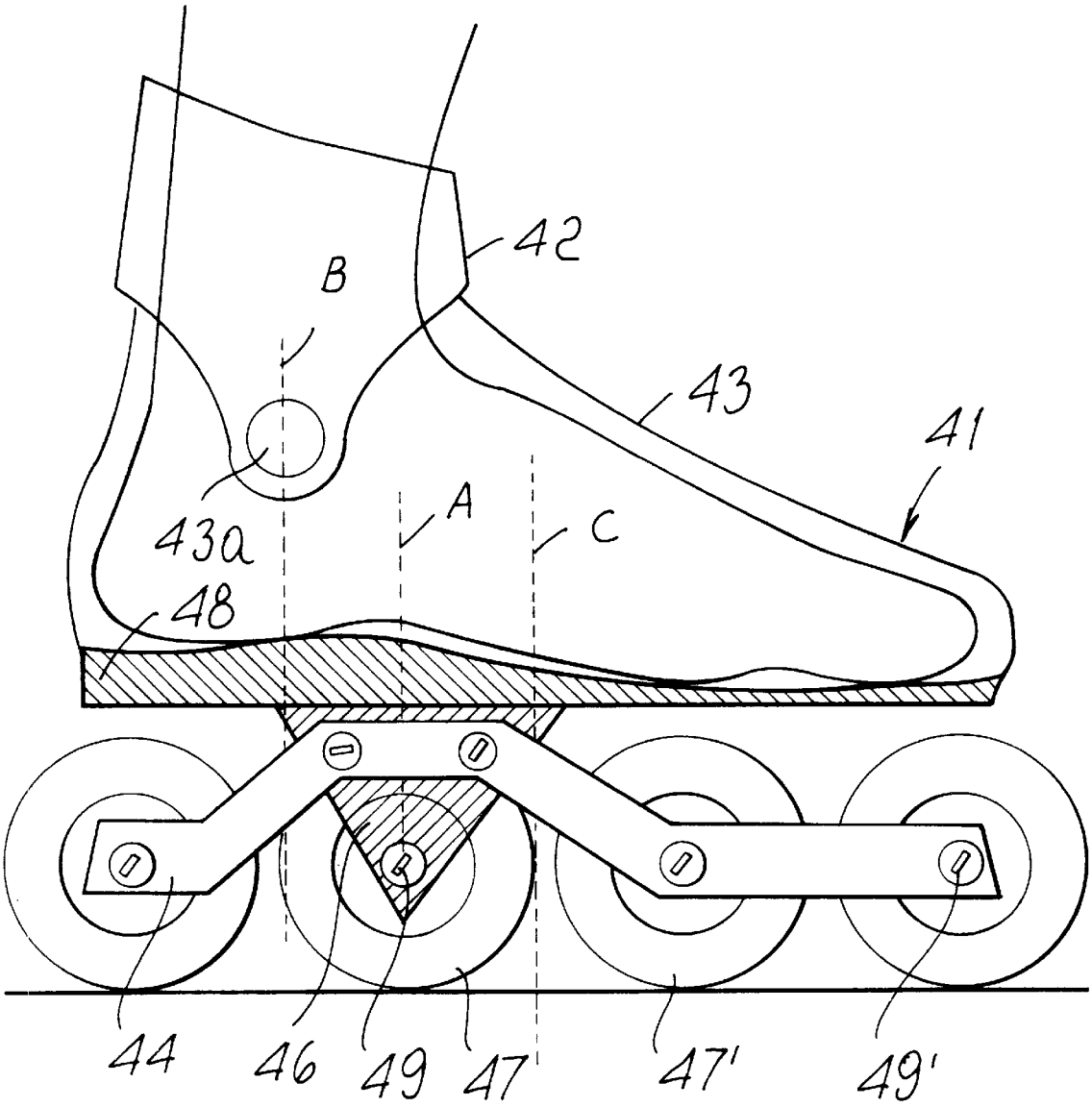
FIG. 6 shows a diagrammatic side view of a roller skate in an embodiment of the invention.
Figure 7:
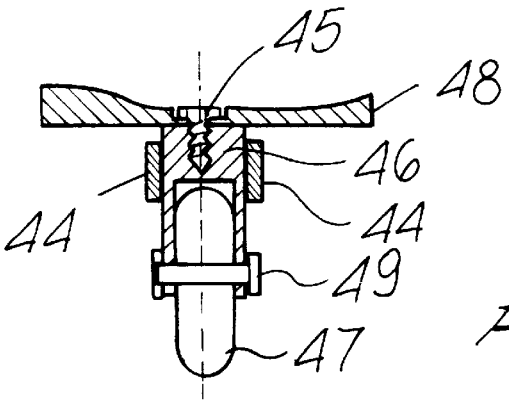
FIG. 7 shows a partial cross-sectional view thereof.

As shown in the drawings according to FIGS. 6 and 7, the roller skate according to the invention substantially comprises a boot 41 composed of a leg portion 42 articulated by means of two pivots 43*a* adjacent the location of the ankle to a foot portion 43. To the sole of boot 41 as a base plate 48 has attached thereto by means of screws 45 a substantially rigid prismatic extension 46 formed as a forked bracket for mounting a roller wheel 47 rotatable about a pin 49.

Attached to the sides of extension 46 are as a support two parallel rigid bars 48 of suitable configuration and interconnected by pins 491 for mounting rollers 47' in longitudinal alignment with roller 47.

In particular, the vertical axis A of extension 46 is disposed at a location between vertical axes B and C passing respectively through the ankle of the foot and through the longitudinal center of the boot.

It is evident that thanks to the positioning of extension 46, the thrust exerted by the skater on sole as a base plate 48 is transmitted directly to the roller (wheel) 47 and so, indirectly, via mentioned parallel rigid bars 44 to the other rollers (wheels) 47' maximizing the thrust/transmission on roller (wheel) 47 and that even when the skater does not assume the perfectly correct posture for skating.

Figure 8:
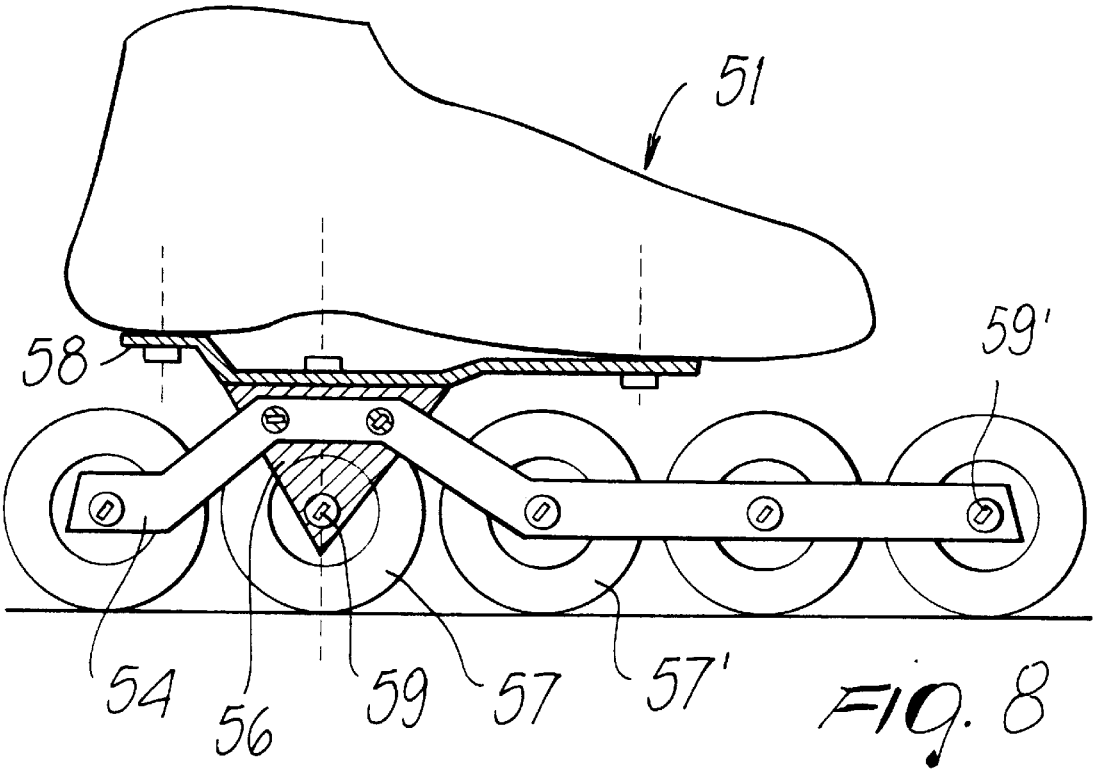
FIG. 8 shows a roller skate in another embodiment.
Figure 9:
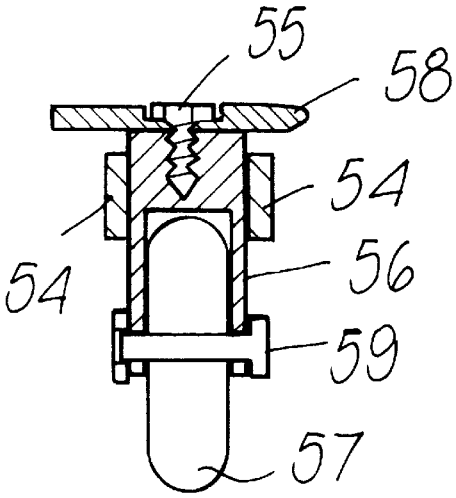
FIG. 9 shows a partial cross-sectional view thereof.

In the embodiment illustrated in FIG. 8, boot 51 is mounted on a base plate 58 itself fixedly connected to extension 56 acting as the mounting support for roller 57 and having the parallel bars 54 for mounting further rollers 57' attached thereto, each roller 57' rotatably arranged about a pin 59'.

Extension 46 could be permitted to displacement in longitudinal and transversal direction in relation with the boot/foot by regulation type, mentioned before (see FIG. 4) by extension slots or various holes permitting to attach extension 46 in different positions on base plate 40' by screws 45. This all for optimizing and personalizing the user's way of skating and so improving skating performance.

What is claimed is:

1. A skate comprising a boot provided at its bottom side with a support for mounting at least one means for movement on a base surface, wherein an insole of said boot is provided with a downwards directed prismatic extension connected to said at least one means for movement on a base surface, said extension being disposed at a location between vertical axes passing respectively through the ankle and through the longitudinal center of the boot and being directly connected to said insole so as to be part of said insole.

2. A skate comprising as means for movement a runner blade on a support which is attached to a sole of a boot, said runner blade being positioned for skating or transport movement on ice as a base surface, further comprising an insole with a downwards directed prismatic extension directly attached to the insole so as to be part of the insole, and interacting with said runner blade at a location between vertical axes passing respectively through the ankle and through the extremity of runner blade in relation of the foot/boot.

3. An ice skate according to claim 2, wherein said insole is accommodated within said boot.

4. An ice skate according to claim 2, wherein said extension is of frustoconical configuration.

5. The ice skate according to claim 2, wherein said prismatic extension is secured to said insole by means of screws.

6. An ice skate according to claim 5, wherein said insole is formed with a longitudinally extending slot opening for the adjustment of said extension.

* * * * *

UNITED STATES PATENT AND TRADEMARK OFFICE

CERTIFICATE OF CORRECTION

PATENT NO. : 5,971,405

DATED : October 26, 1999

INVENTOR(S) : Peter Edauw

It is certified that error appears in the above-indentified patent and that said Letters Patent is hereby corrected as shown below:

This application should be listed as a "National Phase of PCT/EP/02227" filed on June 9, 1995, Italian Application Nos.: VE94U000023, filed on July 8, 1994 and VE948000033, filed on October 4, 1994.

Signed and Sealed this

Twentieth Day of March, 2001

*Attest:*

*Attesting Officer*

NICHOLAS P. GODICI

*Acting Director of the United States Patent and Trademark Office*